US008303082B2

(12) United States Patent
Menzel et al.

(10) Patent No.: US 8,303,082 B2
(45) Date of Patent: Nov. 6, 2012

(54) NOZZLE SHAPE FOR FLUID DROPLET EJECTION

(75) Inventors: Christoph Menzel, New London, NH (US); Paul A. Hoisington, Hanover, NH (US)

(73) Assignee: FUJIFILM Corporation, Tokyo (JP)

( * ) Notice: Subject to any disclaimer, the term of this patent is extended or adjusted under 35 U.S.C. 154(b) by 701 days.

(21) Appl. No.: 12/395,571

(22) Filed: Feb. 27, 2009

(65) Prior Publication Data

US 2010/0220148 A1 Sep. 2, 2010

(51) Int. Cl.
*B41J 2/14* (2006.01)

(52) U.S. Cl. ..... 347/47

(58) Field of Classification Search ..... 347/47
See application file for complete search history.

(56) References Cited

U.S. PATENT DOCUMENTS

| | | | | |
|---|---|---|---|---|
| 4,007,464 | A * | 2/1977 | Bassous et al. | 347/47 |
| 5,818,479 | A | 10/1998 | Reinecke et al. | |
| 6,123,413 | A | 9/2000 | Agarwal et al. | |
| 6,130,693 | A | 10/2000 | Ims et al. | |
| 6,203,145 | B1 * | 3/2001 | Jeanmaire et al. | 347/75 |
| 6,238,585 | B1 | 5/2001 | Miyata | |
| 6,409,308 | B1 | 6/2002 | Maher et al. | |
| 6,423,241 | B1 | 7/2002 | Yoon et al. | |
| 6,520,626 | B1 | 2/2003 | Murakami | |
| 6,640,402 | B1 | 11/2003 | Vooren et al. | |
| 7,347,532 | B2 | 3/2008 | Chen et al. | |
| 7,464,465 | B2 | 12/2008 | Silverbrook | |
| 7,467,851 | B2 | 12/2008 | Silverbrook | |
| 7,712,869 | B2 * | 5/2010 | Silverbrook | 347/47 |
| 7,731,332 | B2 * | 6/2010 | Hori | 347/43 |
| 2004/0051757 | A1 | 3/2004 | Holland | |
| 2006/0261035 | A1 | 11/2006 | Nakanishi | |
| 2007/0187356 | A1 | 8/2007 | Furukawa | |
| 2009/0015637 | A1 | 1/2009 | Worsman et al. | |

FOREIGN PATENT DOCUMENTS

| | | |
|---|---|---|
| JP | 59178258 | 10/1984 |

* cited by examiner

*Primary Examiner* — Lamson Nguyen
(74) *Attorney, Agent, or Firm* — Fish & Richardson P.C.

(57) ABSTRACT

A fluid ejection apparatus includes a substrate having a nozzle surface and a passage through the substrate for fluid flow, the passage having a nozzle that includes an opening in the nozzle surface of the substrate, and an actuator to cause fluid in the passage to be ejected from the nozzle. The nozzle includes side walls extending away from the opening, the side walls sloping outwardly as the side walls extend away. An aspect ratio of a length of the opening to a width of the opening is at least 2:1.

13 Claims, 6 Drawing Sheets

NOZZLE SHAPE FOR FLUID DROPLET EJECTION

TECHNICAL FIELD

The present disclosure relates generally to fluid droplet ejection.

BACKGROUND

In some implementations of a fluid droplet ejection device, a substrate, such as a silicon substrate, includes a fluid pumping chamber, a descender, and a nozzle formed therein. Fluid droplets can be ejected from the nozzle onto a medium, such as in a printing operation. The nozzle is fluidly connected to the descender, which is fluidly connected to the fluid pumping chamber. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device. The ejection of a fluid droplet from a nozzle can be timed with the movement of the medium to place a fluid droplet at a desired location on the medium. Fluid ejection devices typically include multiple nozzles, and it is usually desirable to eject fluid droplets of uniform size and speed, and in the same direction, to provide uniform deposition of fluid droplets on the medium.

SUMMARY

In general, in one aspect a fluid ejection apparatus includes a substrate having a nozzle surface and a passage through the substrate for fluid flow, the passage having a nozzle that includes an opening in the nozzle surface of the substrate, and an actuator to cause fluid in the passage to be ejected from the nozzle. The nozzle includes side walls extending away from the opening, the side walls sloping outwardly as the side walls extend away. An aspect ratio of a length of the opening to a width of the opening is at least 2:1.

This and other embodiments can optionally include one or more of the following features. The substrate can include a flow path body and a nozzle layer, the nozzle layer including a second surface opposite the nozzle surface that joins to the flow path body. The side walls can slope inwardly from the second surface to the nozzle surface. The aspect ratio can be between 2:1 and 50:1. The aspect ratio can be between 2:1 and 20:1, e.g. about 5:1. The opening can form a rectangle. The sloped walls can be at an angle of, for example, between approximately 30° and 60°, such as about 35°, about 45°, or about 54°.

In general, in one aspect, a fluid ejection apparatus includes a substrate having a nozzle surface and a passage through the substrate for fluid flow, the passage having a nozzle that includes an opening in the nozzle surface of the substrate, and an actuator to cause fluid in the passage to be ejected from the nozzle. The opening includes a plurality of substantially linear segments, the substantially linear segments intersecting to form at least one convex corner. An aspect ratio of a length of a first segment in the plurality of substantially linear segments to a width of the first segment is at least 2:1.

This and other embodiments can optionally include one or more of the following features. The substrate can include a flow path body and a nozzle layer, the nozzle layer including a top surface joined to the flow path body and a bottom surface that provides the nozzle surface. A radius of curvature at the convex corner can be less than one-half of the width of the first segment. The substantially linear segments can intersect to form at least one 270° angle. Each segment can have a length and a width, and an aspect ratio of the length to the width of each segment can be at least 2:1. The aspect ratio can be between 2:1 and 50:1. The aspect ratio can be between 2:1 and 20:1, e.g. about 5:1. The opening can form a cross-shape, a T-shape, or an I-shape.

In general, in one aspect, a fluid ejection apparatus includes a fluid reservoir including a liquid having a viscosity of less than 3 cP, a substrate having a nozzle surface and a passage through the substrate for flow of liquid from the reservoir, the passage having a nozzle that includes an opening in the nozzle surface of the substrate, and an actuator to cause liquid in the passage to be ejected from the nozzle. An aspect ratio of a length of the opening to a width of the opening can be at least 2:1.

This and other embodiments can optionally include one or more of the following features. The substrate can include a flow path body and a nozzle layer, the nozzle layer including a second surface opposite the nozzle surface that joins to the flow path body. The viscosity of the liquid can be about 2 cP. The aspect ratio can be between 2:1 and 50:1. The aspect ratio can be between 2:1 and 20:1, e.g. about 5:1. The opening can form a rectangle or an oval.

Some implementations may have one or more of the following advantages. Increasing the aspect ratio of a length to a width of an opening of a nozzle to at least 2:1 can increase resistance of the nozzle without affecting the droplet size. Increasing the resistance can in turn increase stability of droplets during fluid ejection, particularly for those fluids having low viscosity.

The details of one or more embodiments of the invention are set forth in the accompanying drawings and the description below. Other features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

One problem with fluid droplet ejection from a printhead is that volume and velocity of the fluid droplets ejected from nozzles of the printhead module can be unstable, which can lead to inaccuracies in the deposition of droplets onto the print medium, as well as to problems with printhead sustainability. By using a nozzle with an opening having an aspect ratio of greater than 2:1, the increased resistance on the fluid can make the volume and velocity of the droplets more stable, and hence improve the quality of the fluid droplet ejection process, particularly for fluids having a low viscosity.

Figure 1:
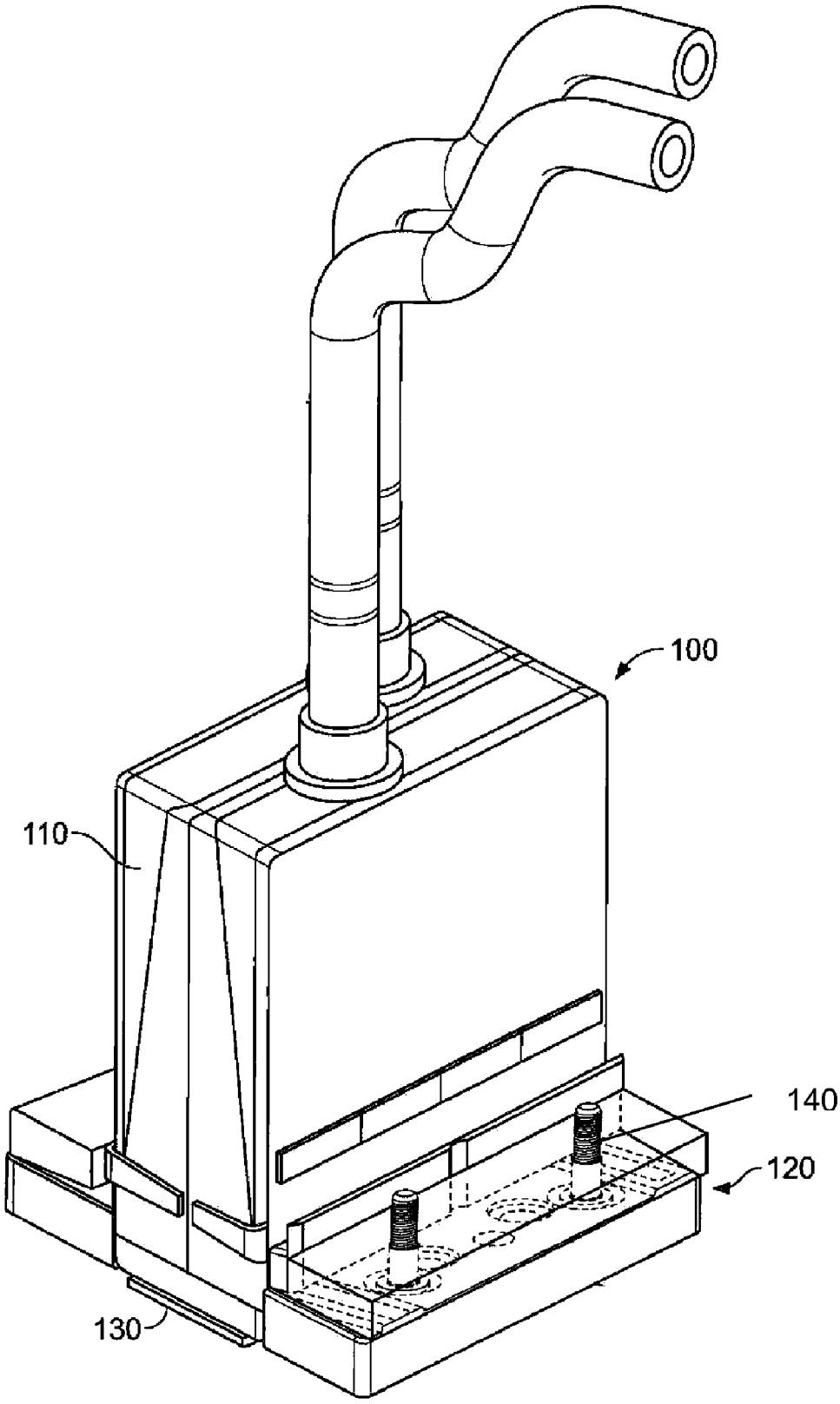
FIG. 1 is a perspective view of an example fluid ejection structure.

Referring to FIG. 1, an implementation of a printhead 100 for fluid droplet ejection includes a casing 110. A mounting assembly 140 is attached to the casing 110 to secure the printhead 100 to a print bar that will hold one or more printheads over the print medium. The printhead 100 also includes a fluid ejection module 120, e.g., a parallelogram-shaped printhead module, which can be a die fabricated using semiconductor processing techniques, attached to the bottom of the casing 110. The printhead module 120 includes a substrate 130 in which a plurality of fluid flow paths 222 are formed. Printhead module 120 further includes a plurality of actuators 680 to cause fluid to be selectively ejected from the flow paths (only one flow path and actuator is shown in the cross-sectional view of FIG. 2). Thus, each flow path with its associated actuator provides an individually controllable MEMS fluid ejector unit. The substrate 130 can be composed of silicon, such as a single crystal silicon.

Figure 2:
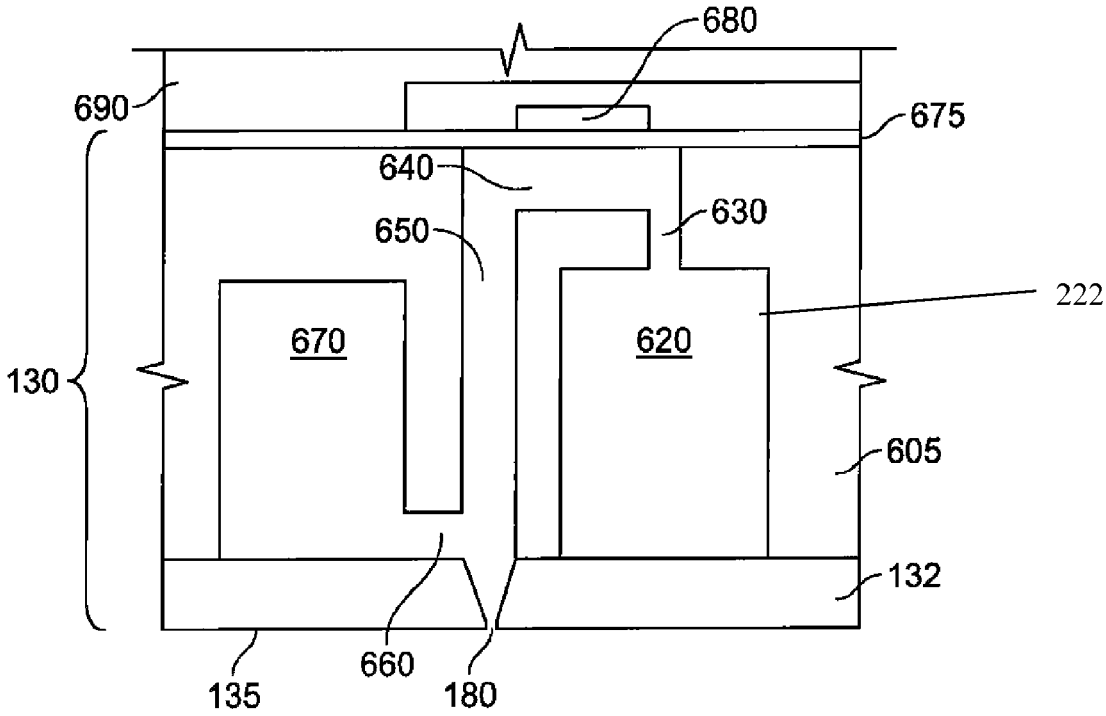
FIG. 2 is a cross-sectional schematic of a portion of an example printhead module.

Referring to FIG. 2, the substrate 130 includes a flow path body 605 with a microfabricated passage or fluid path 222 formed therein. A membrane 675 is formed on the top surface of the flow path body 605, and an actuator 680 is positioned on the membrane 675. Each flow path includes an inlet passage 620 (which can be a common inlet passage for multiple flow paths), an ascender 630, a fluid pumping chamber 640 with a flexible wall provided by the membrane 675, and a descender 650 that leads to a nozzle 180. Optionally, a recirculation passage 660 formed in the flow path body 605 fluidly connects the descender 650 to a return passage 670 (which can be a common return passage for multiple flow paths). When the actuator 680 is actuated, the pumping chamber 640 contracts, forcing fluid through the descender 650 and ejecting a fluid droplet from the nozzle 180.

The substrate 130 also includes a nozzle layer 132 on its bottom surface in which the nozzles 180 are formed. The nozzles 180 can be part of the fluid paths 222 and can extend through the nozzle layer 132. The nozzle layer 132 can be a layer that is secured to the flow path body 605, so that the bottom face 135 is formed as a surface of a separate nozzle layer 132. Alternatively, the nozzle layer 132 can be a unitary part of the substrate 130, e.g., a result of etching of the flow path body.

Figure 3:
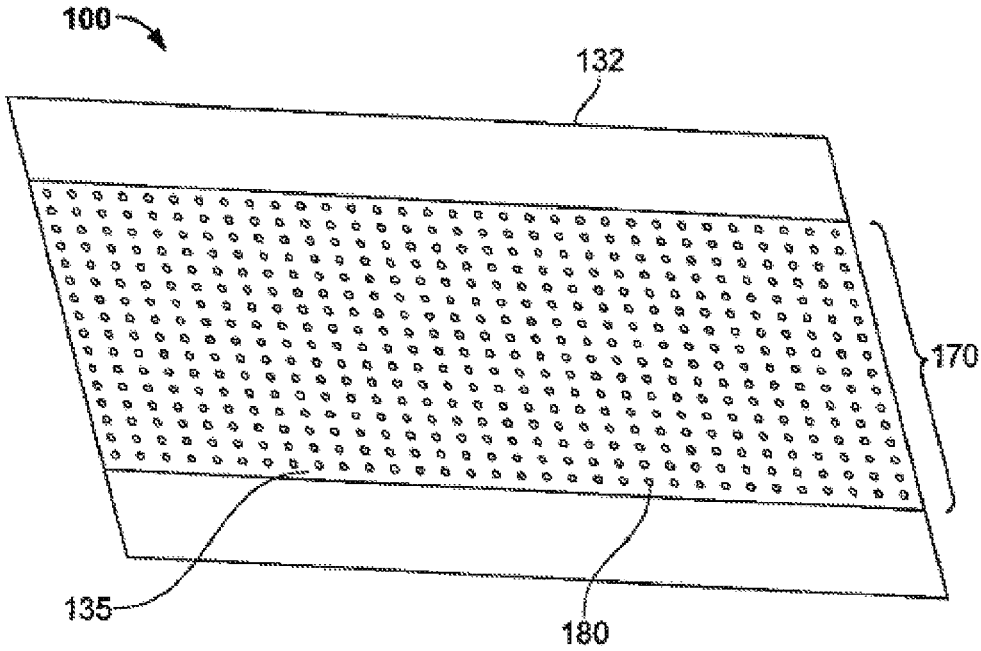
FIG. 3 is a bottom plan view of a nozzle layer.

Referring to FIG. 3 (a bottom view to show the nozzles), each nozzle 180 terminates in an opening in a bottom surface 135 of the substrate 130 or nozzle layer 132. The nozzles 180 can be in a regular array, e.g., the bottom surface 135 can include multiple columns 170 of nozzles 180, although in some implementations the printhead module might include only a single row of nozzles.

Figure 4A:
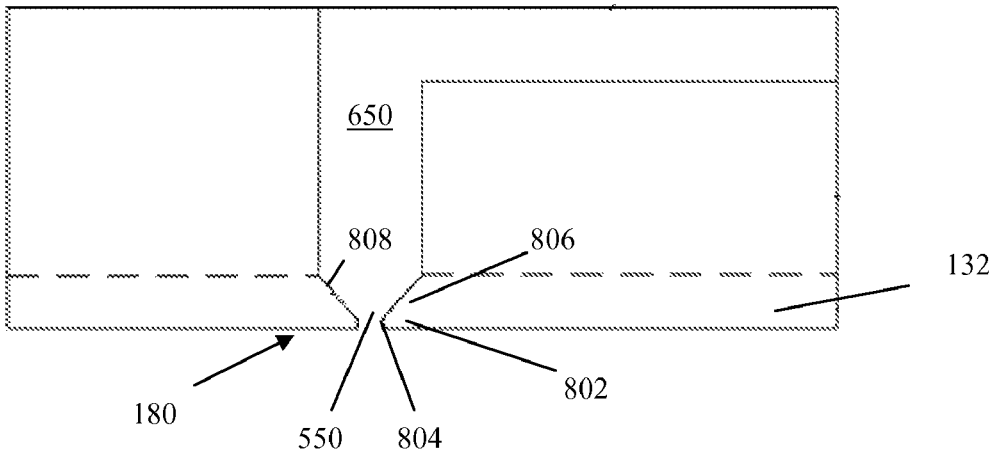
FIGS. 4A, 4B, and 4C are cross-sectional schematics of nozzles in a printhead module.
Figure 4B:
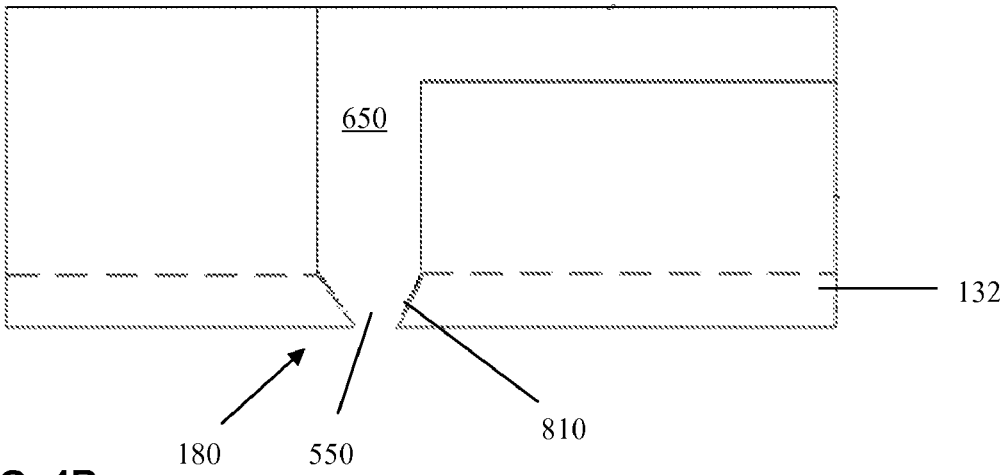
Figure 4C:
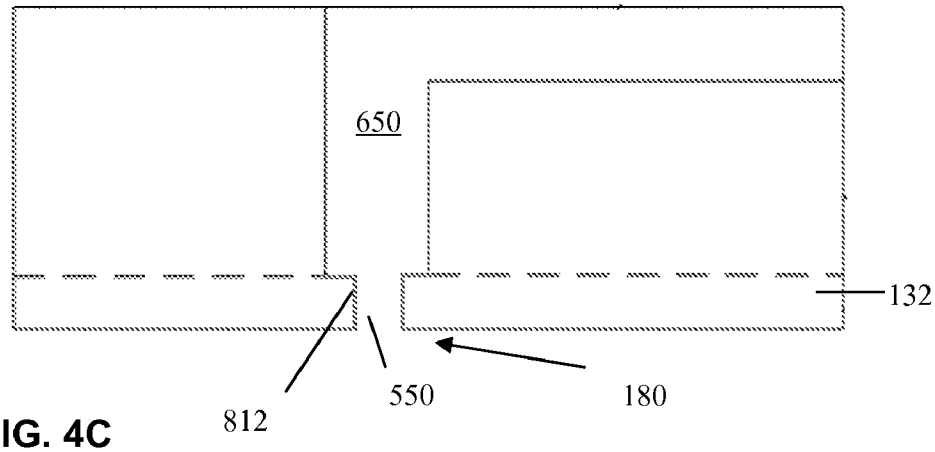

Referring to FIG. 4A, each nozzle 180 can include a lower portion 802 with vertical side walls 804 that lead to the opening 550 in the lower surface of the substrate 130 or nozzle layer 132, and an upper funnel-shaped portion 806 with sloped side walls 808. Alternatively, referring to FIG. 4B, the sloped side walls 810 can extend all the way to the opening 550. In the implementations shown in FIGS. 4A and 4B, the sidewalls 808, 810 of the nozzle 180 can slope outwardly as they extend upwardly. The sloped sidewalls 810 can form an angle of $\sqrt{2}/2$ with the bottom surface 135 of the substrate 130. Alternatively, referring to FIG. 4C, the nozzle 180 can include vertical side walls 812 that extend all the way to the descender 650. Thus, the sides of the nozzles might extend straight up from the opening, i.e. be perpendicular to the plane of the opening 550. In the implementations of FIGS. 4A-4C, the opening 550 can have dimensions, such as one or more length or width, that are parallel to the substrate surface 135.

Figure 4D:
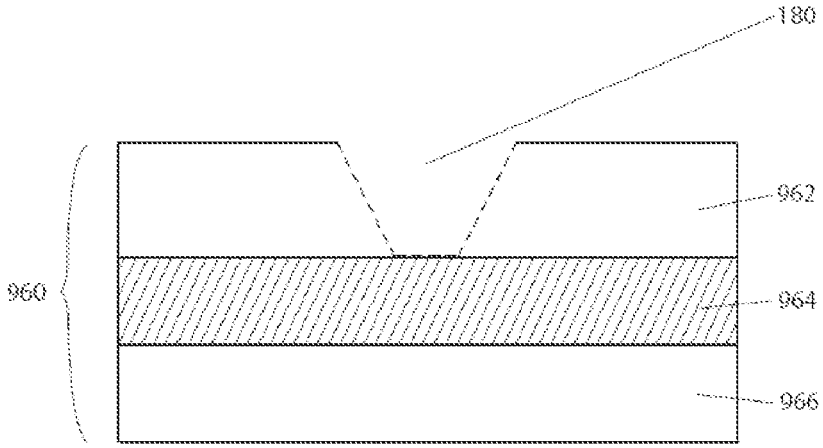
FIG. 4D is a cross-sectional schematic of a multi-layer substrate used to fabricate nozzles.

As shown in FIG. 4D, the nozzles 180 can be formed by, for example, starting with a multi-layer substrate 960, such as a silicon-on-insulator (SOI) substrate. The multi-layer substrate 960 can include a bottom handle layer 966 of silicon, a middle insulator layer 964, and a top nozzle layer 962 of silicon. The silicon nozzle layer 962 can then be etched from its outer surface (the side further from the middle layer) to form the nozzles 180 (only one nozzle formation is shown in FIG. 4D). The silicon nozzle layer 962 can be etched, for example, by anisotropically etching the silicon substrate. An anisotropic etch, such as a wet etch technique, can include, but is not limited to, a technique that uses ethylenediamene or KOH as the etchant. The anisotropic etching removes molecules from the 100 plane much more quickly than from the 111 plane, thus forming sloped walls as shown in FIGS. 4A and 4B. Alternatively, the silicon nozzle layer can be etched by deep reactive ion etching (DRIE). DRIE utilizes plasma to selectively etch silicon to form features with substantially vertical sidewalls, as shown in FIG. 4C.

The etched silicon nozzle layer 962 is then aligned to a flow path body, such as the flow path body 605 (see FIG. 2), that has the descender and other flow path features. The flow path body and the nozzle layer are positioned so that the descender is aligned with the nozzle. The flow path module and nozzle layer are then brought together. After direct silicon bonding, the two silicon layers become joined such that no or virtually no delineation between the two layers exists when the bonding is complete. Once the flow path body and nozzle layer are bonded together, the handle layer 966 of silicon is removed by, for example, a bulk polishing process. The oxide layer 964 can then be completely removed by etching, thus exposing the nozzle opening.

Optionally, the first etching need not extend entirely through the silicon layer, and the silicon nozzle layer 962 can be subjected to an additional etching step, e.g., DRIE etching, from the outer surface after the layer is attached to the flow path body and the handle layer 966 is removed (this can produce the nozzle shown in FIG. 4A).

Figure 5:
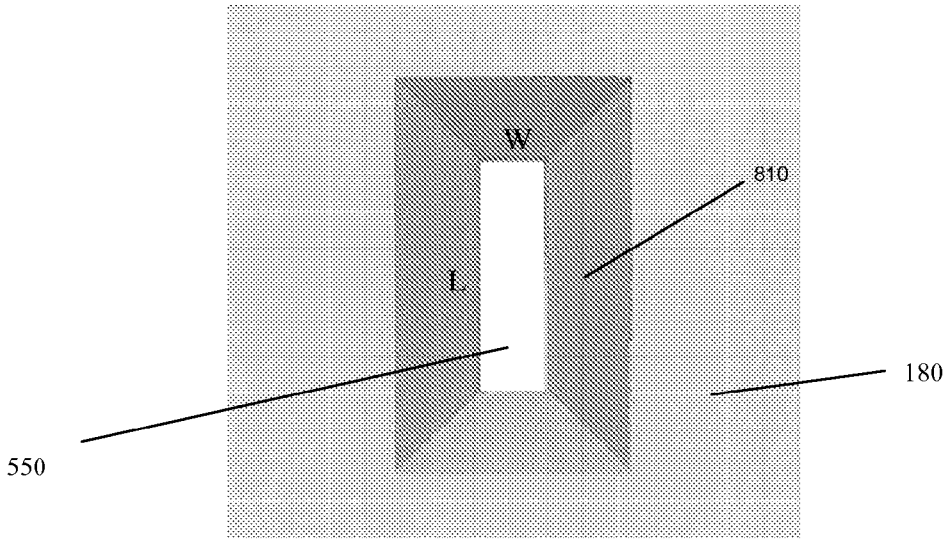
FIG. 5 is a cross-sectional top view of an example rectangular nozzle.

In some embodiments, shown in FIG. 5, the nozzle 180 is rectangular in shape such that the length L of the opening 550 is longer than the width W of the opening 550. The aspect ratio of the length to the width can be between 2:1 and 50:1, e.g. 2:1 to 20:1, such as 2:1, 3:1, 4:1, 5:1, or 6:1. For example, the width can be 5 μm, and the length can be 31 μm.

Figure 6:
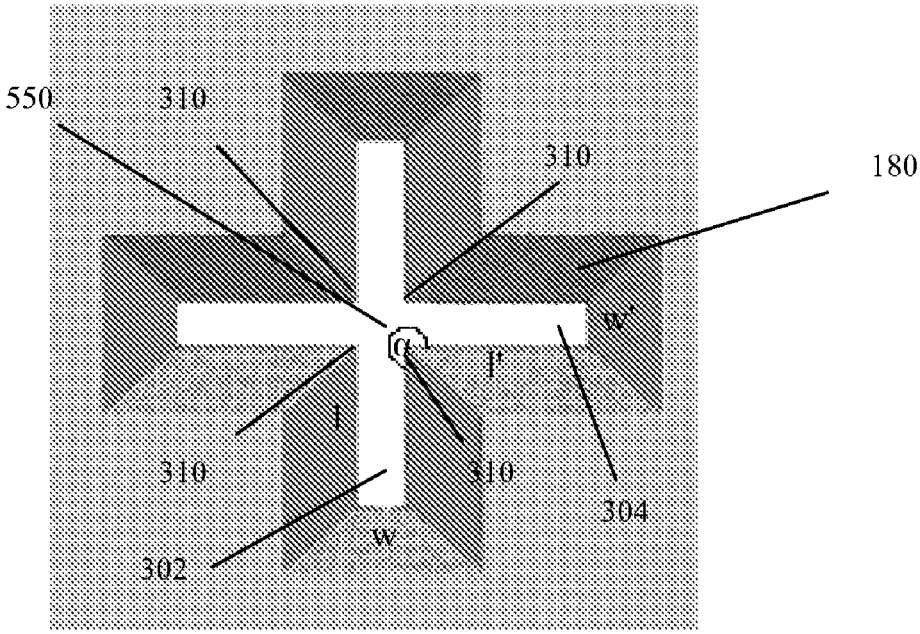
FIG. 6 is a cross-sectional top view of an example cross-shaped nozzle.
Figure 7:
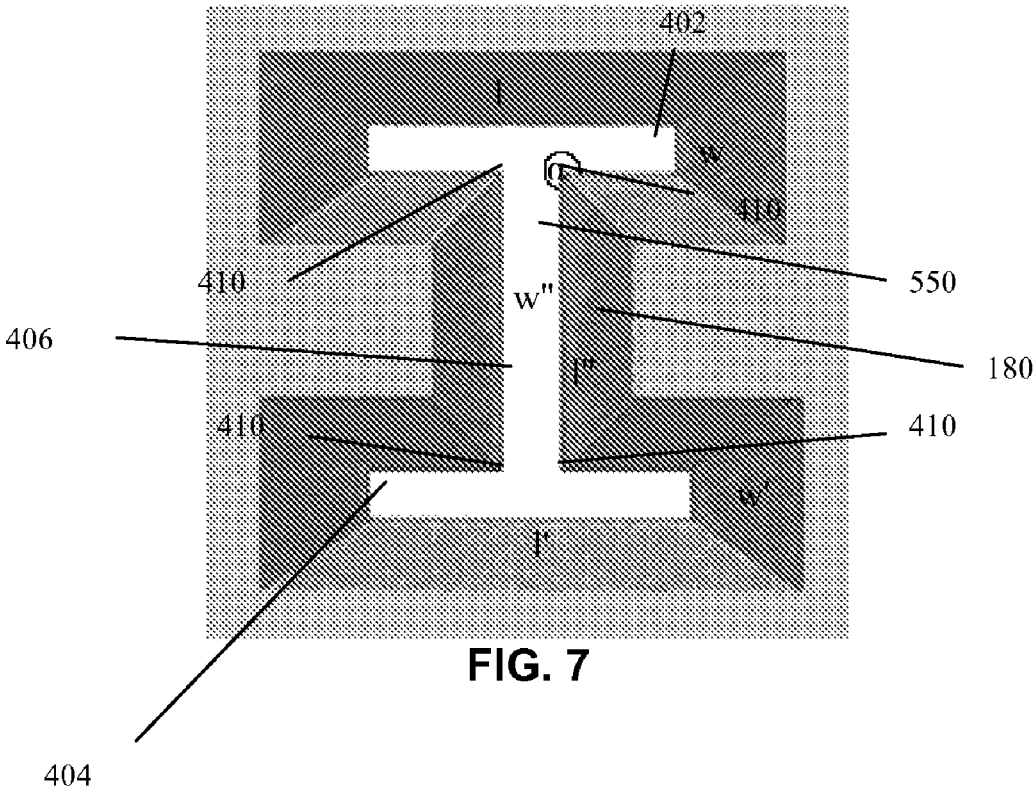
FIG. 7 is a cross-sectional top view of an example I-shaped nozzle.

In other embodiments, for example as shown in FIGS. 6 and 7, the opening 550 includes a plurality of substantially linear segments. The linear segments intersect to form at least one convex corner (that is, the angle $\alpha$ between intersecting interior walls of the nozzle measured across the open region is more than 180°). In the implementation of FIG. 6, linear segments 302, 304 intersect in a cross shape. Convex corners 310 are formed at the intersection of the linear segments 302, 304. For example, corners 310 can be approximately 270° (measured across the open region). The radius of curvature at corners 310 is less than one-half of the width w of the linear segment 302 or the width w' of the linear segment 304. The length l of linear segment 302 is longer than the width w of the linear segment 302. Likewise, the length l' of the linear segment 304 is longer than width w' of the linear segment 304. Similar to the embodiment shown in FIG. 2, the aspect ratios of l to w and/or l' to w' can be between 2:1 and 50:1, such as 2:1, 3:1, 4:1, 5:1, or 6:1. Although the linear segments 302, 304 are shown in FIG. 6 as intersecting near a midpoint of each linear segment, they need not do so. For example, the linear segments can form an L or T-shape. Further, although the linear segments 302, 304 are shown in FIG. 6 as having the same length and width, the lengths and/or widths of each linear segment can be different from one another. Moreover, although only two linear segments are shown in the embodiment of FIG. 6, additional numbers of linear segments are contemplated, such as between 3 and 6 linear segments.

In the implementation of FIG. 7, the opening 550 in the nozzle 180 is I-shaped. Thus, the nozzle 180 has three linear segments 402, 404, and 406. Convex corners 410 are formed at the intersection of the linear segments 402, 404, 406 with each other. The lengths l, l', and l" are longer than the respective widths w, w', and w". Thus, similar to the embodiments of FIGS. 5 and 6, the aspect ratios of the lengths and widths of one or more of the linear segments 402, 404, 406 can be between 2:1 and 50:1 e.g. 2:1 to 20:1, such as 2:1, 3:1, 4:1, 5:1, or 6:1. Further, as in the embodiment of FIG. 6, although the widths of the linear segments 402, 404, 406 are shown as equivalent, and the lengths of the linear segments 402, 404 are shown equal to each other and less than the length of the linear segment 406, they need not be so. For example, all lengths l, l', l" maybe be equivalent to each other, and all widths w, w', w" may be equivalent to each other. Alternatively, all lengths and widths may be different, or some may be different and some the same.

Other shapes of the openings 550 of the nozzles 180 having an aspect ratio of greater than 2:1 are contemplated. For example, the opening 550 of nozzle 180 might be ovalshaped or star-shaped. Alternatively, segments of the opening 550 might not be linear, but rather might be rounded or curved. In some implementations, the shape of the openings 550 of nozzles 180 may be constrained by the ability of multiple nozzles to fit onto nozzle layer 132. Further, in some implementations, the shape of the nozzle openings may be constrained by the etching process, as the convex corners may need a mask with corner compensation features of a KOH etching process to compensate for the undercut that occurs at the corners of the more complex shapes discussed herein.

During operation of fluid ejection module 100, fluid flows through the substrate inlets (not shown) into the inlet passages 620. Fluid then flows through the ascender 630, through the fluid pumping chamber 640, and through the descender 650. From the descender 650, fluid can flow through the optional recirculation passage 660 to the return passage 670. When the transducer 680 is actuated, a pressure pulse travels down the descender 650 to the nozzle 180, and this pressure pulse can cause ejection of a fluid droplet through the nozzle 180.

Variations in different flow conditions, such as nozzle fullness, flow rate, flow direction, and fluid viscosity can cause variations in the impedance in the nozzle area, which can in turn cause variations in the fluid ejection process. For example, if the resistance at nozzle 180 is low, e.g. as a result of low viscosity or large nozzle opening area, the droplet meniscus can become instable, causing inaccuracies in the fluid droplet ejection process. In contrast, if the resistance at nozzle 180 is high, e.g. as a result of a low nozzle opening area or high viscosity, then the fluid may not be able to be ejected without increasing the voltage required to fire a fluid droplet.

If constraints in the fluid ejection process require that the droplet size remain constant, e.g. 0.5 pL-5 pL, such as a 2 pL native drop and that the fluid viscosity remain low, such as less than 6 cP, e.g., 2-3 cP, then the resistance of a nozzle having a square opening may not be enough to stabilize the droplet meniscus. The resistance can be increased by increasing the aspect ratio of the nozzle opening. That is, the droplet size is generally proportional to the area of the nozzle opening. In contrast, the resistance is proportional to the cube of the smaller dimension and linear to the larger dimension of the nozzle opening. The relationship between resistance, area, and the aspect ratio is shown by the following equation:

$$R=C\mu L/(a^3b)$$

where R is the resistance, C is a constant dependent on the ratio of the smaller dimension of the opening to the larger dimension of the opening, μ is the viscosity, L is the length of the nozzle side walls, a is the width of the opening, and b is the length of the opening Thus, for example, if the nozzle area is maintained, but the aspect ratio of the nozzle opening is increased, then the resistance in the nozzle can be increased without changing the area of the opening (and thus essentially without changing the droplet size). The aspect ratio can be increased, for example, by implementing a nozzle as described herein, such as nozzles having a rectangular, cross-shaped, or I-shaped opening. Further, by changing both the voltage and the aspect ratio of a particular design, it is possible to get a second design having the same velocity and volume, but having an increased resistance to stabilize the droplet meniscus.

The use of terminology such as "front," "back," "top," "bottom," "above," and "below" throughout the specification and claims is to illustrate relative position and orientation of various components of the system, and does not imply a particular orientation of the printhead or any other components with respect to gravity.

Particular embodiments of the invention have been described. Other embodiments are within the scope of the following claims.

What is claimed is:

1. A fluid ejection apparatus comprising:

a substrate having a nozzle surface and a passage through the substrate for fluid flow, the passage having a nozzle that includes an opening in the nozzle surface of the substrate; and an actuator to cause fluid in the passage to be ejected from the nozzle;

wherein the nozzle includes side walls extending away from the opening, the side walls sloping outwardly as the side walls extend away, and wherein an aspect ratio of a length of the opening to a width of the opening is at least 2:1;

wherein the substrate includes a flow path body and a nozzle layer, the nozzle layer including a second surface opposite the nozzle surface that joins to the flow path body.

2. The fluid ejection apparatus of claim 1, wherein the side walls slope inwardly from the second surface to the nozzle surface.

3. The fluid ejection apparatus of claim 1, wherein the aspect ratio is between 2:1 and 50:1.

4. The fluid ejection apparatus of claim 3, wherein the aspect ratio is between 2:1 and 20:1.

5. The fluid ejection apparatus of claim 4, wherein the aspect ratio is about 5:1.

6. The fluid ejection apparatus of claim 1, wherein the opening forms a rectangle.

7. A fluid ejection apparatus comprising:

a fluid reservoir comprising a liquid having a viscosity of less than 3 cP;

a substrate having a nozzle surface and a passage through the substrate for flow of liquid from the reservoir, the passage having a nozzle that includes an opening in the nozzle surface of the substrate, wherein an aspect ratio of a length of the opening to a width of the opening is at least 2:1; and an actuator to cause liquid in the passage to be ejected from the nozzle;

wherein the substrate includes a flow path body and a nozzle layer, the nozzle layer including a second surface opposite the nozzle surface that joins to the flow path body.

8. The fluid ejection apparatus of claim 7, wherein the viscosity of the liquid is about 2 cP.

9. The fluid ejection apparatus of claim 7, wherein the aspect ratio is between 2:1 and 50:1.

10. The fluid ejection apparatus of claim 9, wherein the aspect ratio is between 2:1 and 20:1.

11. The fluid ejection apparatus of claim 10, wherein the aspect ratio is about 5:1.

12. The fluid ejection apparatus of claim 7, wherein the opening forms a rectangle.

13. The fluid ejection apparatus of claim 7, wherein the opening forms an oval.

* * * * *